United States Patent [19]

Kakimoto et al.

[11] Patent Number: 4,505,469

[45] Date of Patent: Mar. 19, 1985

[54] PAPER FEEDING APPARATUS

[75] Inventors: Atsushi Kakimoto, Yao; Masaaki Takita, Ibaragi; Shinichi Watanabe, Neyagawa, all of Japan

[73] Assignee: Matsushita Electric Industrial Co., Ltd., Kadoma, Japan

[21] Appl. No.: 456,048

[22] PCT Filed: Apr. 19, 1982

[86] PCT No.: PCT/JP82/00127

§ 371 Date: Dec. 21, 1982

§ 102(e) Date: Dec. 21, 1982

[87] PCT Pub. No.: WO82/03617

PCT Pub. Date: Oct. 28, 1982

[30] Foreign Application Priority Data

Apr. 21, 1981 [JP] Japan ..... 56-61071

[51] Int. Cl.[3] ..... B65H 3/40

[52] U.S. Cl. ..... 271/91; 271/103

[58] Field of Search ..... 271/91, 93, 103

[56] References Cited

U.S. PATENT DOCUMENTS 3,931,964 1/1976 Schwebel ..... 271/93

FOREIGN PATENT DOCUMENTS 1055014 4/1959 Fed. Rep. of Germany ..... 271/103
53-87575 7/1978 Japan .
54-138279 10/1979 Japan .

OTHER PUBLICATIONS

IBM Technical Disclosure Bulletin, vol. 7, No. 2, Jul. 1964, pp. 138, 139, "Vacuum Foot Separator", T. Barna.

*Primary Examiner*—Richard A. Schacher
*Attorney, Agent, or Firm*—Cushman, Darby & Cushman

[57] ABSTRACT

A separation mechanism part is provided wherein a negative pressure to suck a recording paper apart from a stack is obtainable by contacting an uppermost sheet of the recording paper using a suction head, air flow into the suction head being cut off by contact of the suction head with the first sheet of the recording paper. The recording paper is sucked and separated one sheet by one sheet by bringing up the suction head, as such, by the negative pressure. This paper feeding apparatus can feed recording paper surely separated sheet by sheet, and even though the amount of piling of the recording paper in the piled state changes, the separating force applied to act on the uppermost sheet of recording paper when suction is applied is kept small and uniform.

8 Claims, 6 Drawing Figures

PAPER FEEDING APPARATUS

FIELD OF THE INVENTION

This invention relates to a paper feeding apparatus for use in in a rotary drum type recording apparatus or the like, for feeding sheets of recording paper sheet by sheet from a stack, by utilizing suction.

BACKGROUND OF THE INVENTION

Though in recording apparatus or the like, taking out paper sheet by sheet from a stack has been done for a long time, because the force acting between a sheet of paper to be separated and the remaining sheets is very unstable there has been a problem that not only one sheet, but two sheets or three sheets or more together are separated, or nothing is separated.

Several methods have been deviced for solving this problem but the best method is not found yet so far.

Conventional ways of separating papers in the piled state one sheet by one sheet are classified largely into two kinds, a method to utilize friction of a rubber roller or the like, and another method to utilize suction force of air.

The method to utilize the friction of a rotating rubber roller is one to utilize difference between friction of the rubber roller and the paper and friction between the paper to be separated and the next paper, at the time the rotating rubber roller is pressed to the first paper.

However, in such method the above-mentioned difference of friction is regulated by surface condition of the rubber roller or the like and contact pressure at contacting of the rubber roller to the paper, and because of change of the surface condition as time clapses or because of decrease of the friction due to a sticking of fiber of the paper onto the surface of the rubber roller as a result of friction, the friction between the rubber roller and the paper becomes unstable. Also, since elasticity of the piled paper changes responding to the way the paper has been handled, the contact pressure is difficult to keep constant with respect to change of the piled amount; on the other hand when the contact pressure is made large in order to relatively decrease variation in the amount of the contact pressure, then the paper often is broken due to friction. Also, in order to supplement the unstability of the difference of friction, there has been devised an apparatus to return the second or subsequent paper, but such device becomes very complicated.

On the other hand, though in case of utilizing the suction force of the air there is an advantage that there is almost no effect of the friction force, when the paper is vertically separated a vacuum is produced between the first paper and the next paper and it, too, receives the effect of the vacuum. That is, most devices which utilize the suction have such configuration as to press a suction chuck to the uppermost paper and to bring up the chuck in an upward or slant upward direction, and in this method the difference of force between the force to suck the paper and the force which is generated at the separation of the paper and acts in a direction to hinder the separation, thus becoming a problem. Although by making the force to suck the paper large, the effect of separating the paper can be increased, it is necessary to make the apparatus large in order to increase the suction force, and, for some kinds of paper, two or more papers becomes sucked up at the same time, so there is a necessity to provide means to forcibly drop the second and subsequent ones and the apparatus becomes complicated.

SUMMARY OF THE INVENTION

A separation mechanism part is provided wherein a negative pressure to suck a recording paper apart from a stack is obtainable by contacting an uppermost sheet of the recording paper using a suction head, air flow into the suction head being cut off by contact of the suction head with the first sheet of the recording paper. The recording paper is sucked and separated one sheet by one sheet by bringing up the suction head, as such, by the negative pressure. This paper feeding apparatus can feed recording paper surely separated sheet by sheet, and even though the amount of piling of the recording paper in the piled state changes, the separating force applied to act on the uppermost sheet of recording paper when suction is applied is kept small and uniform.

DETAILED DESCRIPTION

Figure 1:
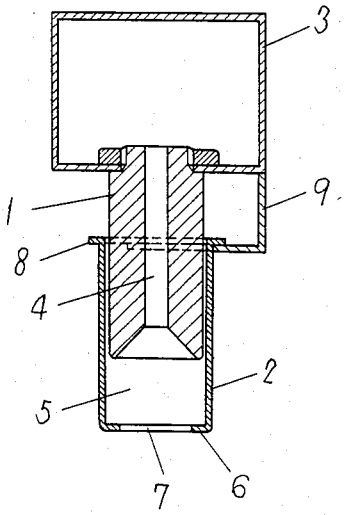
FIG. 1 is a sectional view showing the operation mechanism of a paper feeding apparatus in accordance with an embodiment of the present invention.

FIG. 1 shows the separation mechanism of a paper feeding apparatus in accordance with an embodiment of the present invention. In FIG. 1, numeral 1 designates a representative one of a plurality of pipes. Numeral 2 designates a suction head which is disposed outside the pipe 1 so as to be slidable along the axis of the pipe 1; numeral 3 designates a duct connected to a suction pump as sucking means and to one end of each of the above-mentioned pipes 1. The inside space of the duct 3 is connected to outside through the face 4 of the pipe 1. Also, the duct 3 has a section area and section shape such the fluidic resistance of the air flow is sufficiently small. It is considered that effect to be given from the air path 4 of the pipe 1 connected to the duct 3 becomes as small as possible.

The tip of the air path 4 provided on said pipe 1 is made fluidically small in resistance, and in order to increase the capacity of the air chamber 5 formed between the suction head 2 and itself, it is flared becoming wider nearer the open end. Also, by forming it in the flared shape, the sucking area when sucking the recording paper becomes large. Furthermore, the pipe 1 guides the sucking pipe 2 in order that the suction head 2 can slide upward and downward freely rotating. Incidentally, though there is a small gap radially between the pipe 1 and the suction head 2, they are fitted in a manner to have a fluidically sufficient large resistance.

The above-mentioned suction head 2 is constructed of a low specific gravity metal such as aluminum or a light-weight material of synthetic resin such as plastic or paper or the like. The suction head 2 has a bottom which forms suction plane 6, and a suction aperture 7 for sucking the top sheet of recording paper against the suction head is provided at the suction plane 6. Also, a collar 8, formed by drawing or a like method, is provided at the upper end of the suction head 2. By providing the collar 8, the strength of the suction head 2 is increased. Furthermore, the collar 8 of the suction head 2 is, for engaging with the metal stop member 9, fixed to the above-mentioned duct 3 when the suction head 2 goes down to its lowest position, and, by the collar and the metal stop 9, the suction head 2 is made not to fall off the pipe 1. In the sucking pipe 2, the pressure difference generated at the suction aperture 7 by air flow which is flowing through the air path 4 of the pipe 1 acts to bring up the suction head 2 itself, but the size of the above-mentioned suction aperture 7 is so designed that the suction head 2 is not brought up until the suction aperture 7 of the suction head 2 is blocked by confrontation with a sheet of the recording paper, even when a force tending to bring up the suction head 2 is present. That is, until the suction aperture 7 of the suction head is blocked by the recording paper, the suction head 2 remains in the state that the collar is engaging the metal stop 9, and in this state when the suction plane 6 touches the upper end of the accumulated recording paper, the suction aperture 7 is closed and air in the air chamber 5 is drawn through the air path 4. The chamber 5 thus becomes under a negative pressure, and the recording paper is sucked against the suction head, blocking the aperture 7. Also, at the same time, by means of this negative pressure the suction heads 2 are brought up. Actions of these periods are carried out in a short time, and to a recording paper of the accumulated state the weight of the suction heads 2 is impressed only for very short time until the suction apertures 7 are closed.

Figure 2:
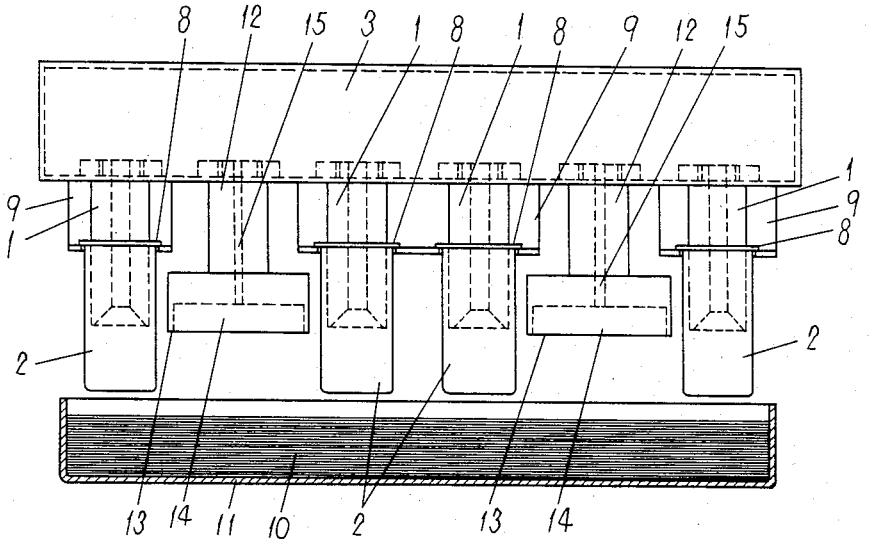
FIG. 2 is a front view of the paper feeding apparatus.
Figure 3:
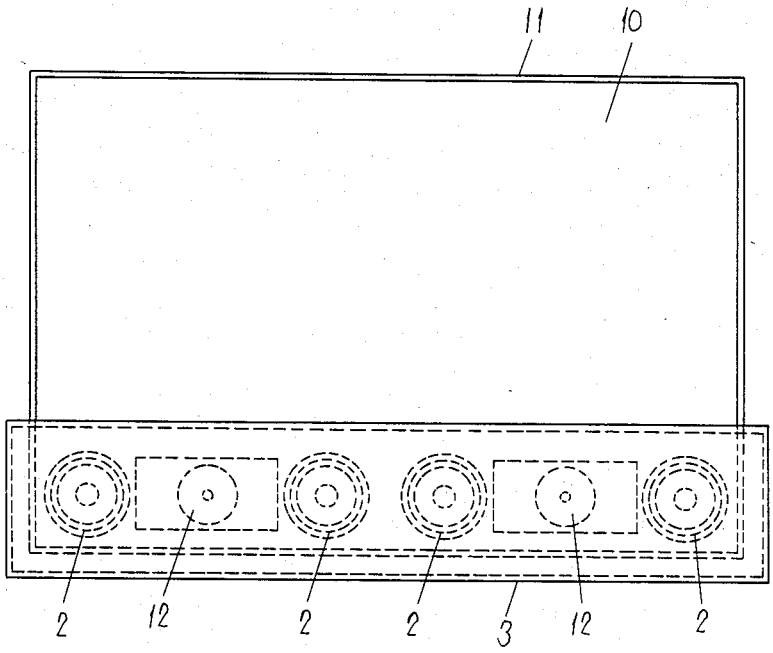
FIG. 3 is a plan view seen from above the same paper feeding apparatus.

FIG. 2 and FIG. 3 show paper feeding apparatus using the separation mechanism of FIG. 1. In FIG. 2 and FIG. 3, numeral 10 designates piled recording papers, numeral 11 designates a tray for piling and storing the recording paper 10; numeral 12 designates a holding pipe for sucking and holding the separated recording paper 10. At the suction plane 13 of the holding pipe 12 there is provided a suction aperture 14 having a broad area. The positions of the suction planes 13 are formed to be of the same height as the suction planes 6 of the suction heads 2 when the suction heads 2 of the separation mechanism rise up. Furthermore, the holding pipes 12 also are fixed at their one end to the duct 3 like the pipes 1 of the above-mentioned separation mechanism. The inside space of the duct 3 is connected to the outside through the air paths 15 and the suction apertures 4 of the suction heads 2. When the sucking pump is being driven, air is flowing in through the suction apertures 14 of the holding pipes 12 and the air paths 15.

Until the recording paper 10 is sucked to the holding pipes 12, as above-mentioned, the air is flowing in through the suction apertures 14, and accordingly when the fluidic resistance of the air paths 15 of the holding pipes 12 is small, the suction force applied against the recording paper 10 by the suction heads 2 becomes small, and the ability for drawing and separating one sheet of recording paper 10 from the piled recording paper 10 becomes small. Therefore, in this embodiment, areas of the suction planes 13 of the holding pipes 12 and fluidic resistances of the air paths 15 are made to be larger than the areas of the suction planes 6 of the suction heads 2 and the fluidic resistances of the air paths 4 of the pipe 1, respectively.

Also, as shown in FIG. 2 separation by the four suction heads 2 and fluidic resistance of the holding by the two holding pipes 12 are determined in such a manner that lowering of the sucking force generated by air flowing through the two suction heads 2 becomes small when, for instance half of the four suction heads 2 and two holding pipes 12 are used for separation and holding, respectively, that is, when the size of the sheets of recording paper 10 is half of that shown in FIG. 2.

In the embodiment shown in FIG. 2 and FIG. 3, four of the suction heads 2 and two of the holding pipes 12 are provided, but the construction is not limited to this, and an appropriate configuration can be selected depending on the physical characteristics or mechanical characteristics of the recording paper 10.

When two sheets or multiple sheets of the recording paper or the like thin-sheet-like substance are tightly sticking each other, it is confirmed from experience that in order to separate them, it is easier to peel them from an end or corner. By utilizing this, in the embodiment shown as in FIG. 3, the sucking parts are disposed in such a manner that the sucking positions come to the end parts of the recording paper 10. Also, as shown in FIG. 2, in this embodiment four of the suction heads 2 are disposed on both ends and at center. Each of the four suction heads 2 can move individually. Therefore, the uppermost sheet of recording paper 10 is separated from the end which is easier to be separated, instead of that the uppermost recording paper is separated in a parallel state.

Figure 4:
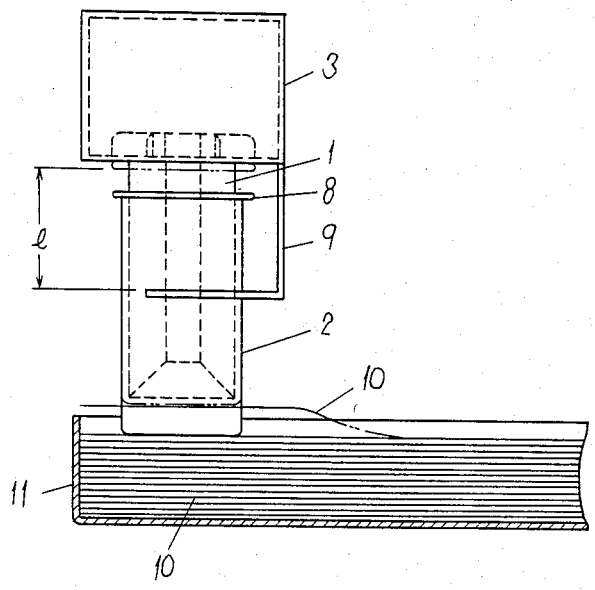
FIG. 4 and FIG. 5 are side views for elucidating additional relations of sucking pipes responding to change in the number of sheets of recording paper in the stack and, FIG. 6 is a configuration drawing to show schematical configuration of a recording apparatus of rotary drum type.
Figure 5:
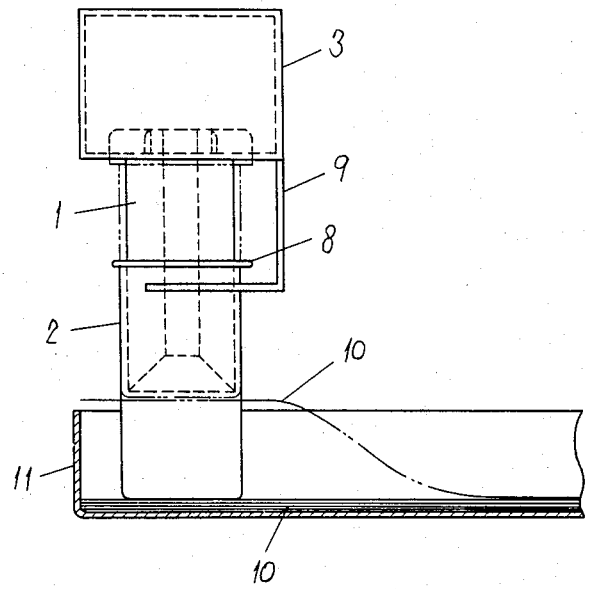

FIG. 4 and FIG. 5 show a relation between the amount of the piled recording papers 10 and displacement of a suction head 2. The suction head 2 can move by the distance l as shown by an arrow. Accordingly, by setting the piling amount of the recording paper within the distance of l, even when the accumulation amount varies the force to act on the recording paper 10 is only the weight of the suction head 2 as described above, and no effect is received at the time of sucking separation.

Figure 6:
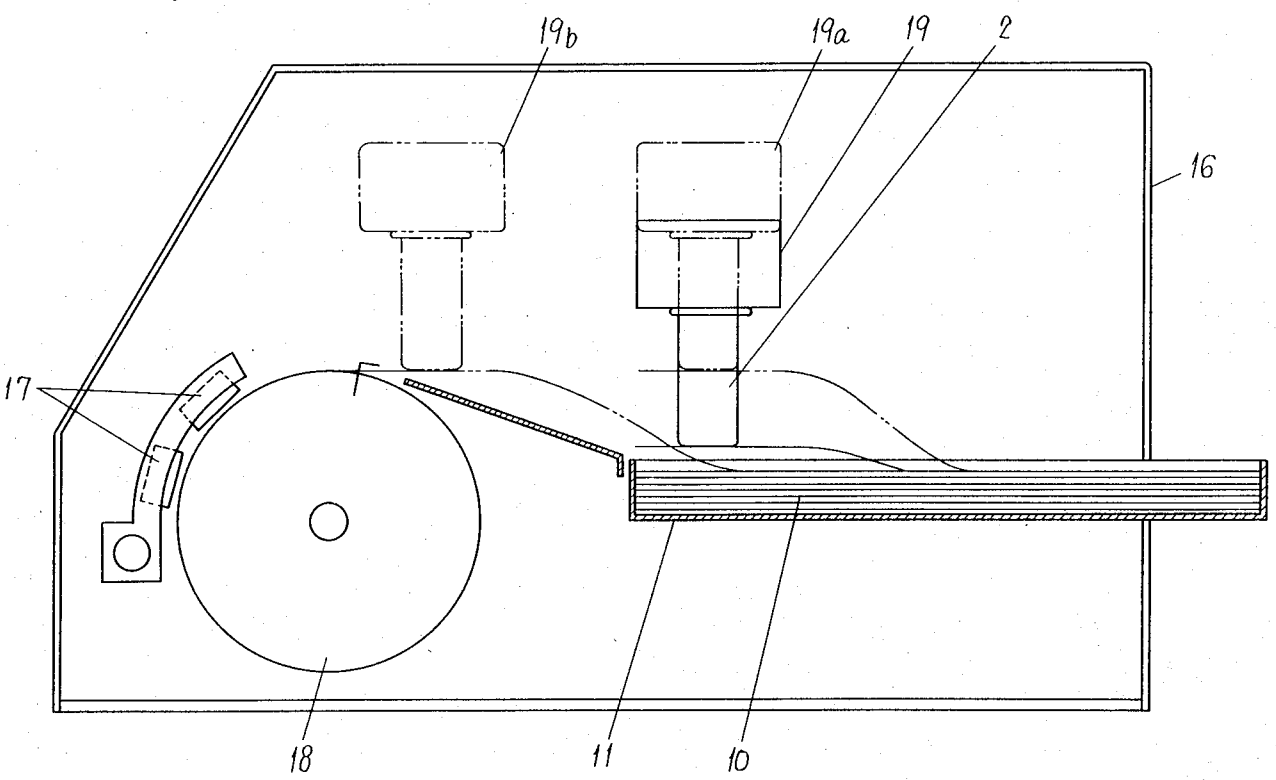

In FIG. 6, a schematic configuration of a rotary type recording apparatus which uses the paper feeding apparatus of the above-mentioned embodiment is shown. In FIG. 6, numeral 16 designates a main housing, numeral 17 designates a recording head; numeral 18 designates a rotary drum for recording, and numeral 19 designates a suction part of the paper feeding apparatus shown in FIG. 1 through FIG. 3. The state of the suction part 19 shown by solid lines is the state of the suction part when the suction heads 2 rise, separating one sheet of the recording paper 10. This suction part 19 goes up to the position 19*a* shown by two dot chain lines by transfer means (not shown in figure), and horizontally moves up to the position 19*b*, whereby the recording paper 10 is fed to the rotary drum 18. In the similar way, subsequently, from the piled state the recording paper is separated and taken out sheet by sheet, and fed to the rotary drum 18.

By touching the suction heads to the uppermost sheet of recording paper, and thereby cutting off the air flow, the inside of each suction head becomes under a negative pressure and the recording paper is sucked against the suction heads. By bringing up each suction head itself by this negative pressure, one sheet of the recording paper is separated from the stack, and when this one sheet is taken from the stack it is possible to make the force acting in an opposite direction to the separation direction as small as possible. Also a force to act on the recording paper at the separation can be made constant with respect to the change of the accumulation of the recording paper, and the piled recording paper can be separated and taken out one sheet by one sheet surely. The configuration can be simply constructed.

We claim:

1. Apparatus for feeding paper, sheet by sheet, from a pile of such paper, to a processing station at which information is to be recorded thereon, said apparatus comprising:

wall means defining a duct which is constructed and arranged to be communicated to a suction-drawing air pump;

at least one generally vertically downwardly-directed suction pipe secured to said duct;

each said suction pipe having means defining a longitudinal bore therein having an upper end opening into said duct and a lower end opening downwardly outside said duct;

at least one at least generally vertically-oriented suction head having a downwardly-opening suction aperture disposed in a generally horizontal suction plane;

means mounting each such suction head relative to said duct for limited, at least generally vertical, travel between a defined lowermost position, and an upper position;

each such suction head being telescopically generally vertically slidingly received on a lower end portion of a respective said suction pipe in such a manner as to enclose respective said lower end of a respective said suction pipe, thereby defining within each said suction head between the respective said suction pipe lower end and the respective said suction aperture, a suction chamber;

each suction head being of a weight which is slightly greater than that needed to counterbalance the tendency of air being sucked into the respective said suction chamber when said apparatus is in use to cause that suction head to rise from said lowermost position thereof so that, (a) when each said suction head has the respective said aperture thereof open and not blocked by confrontation with a surface of a sheet of paper, such suction head tends to assume and mainain said lowermost position thereof under the influence of gravity, but (b) when each suction head has the respective said aperture thereof closed and blocked by confrontation with a surface of a sheet of paper, such suction head tends to rise to said upper position thereof;

at least one holding pipe communicated to said duct and having a downwardly opening aperture which is constructed and arranged to grip by suction a sheet of paper elevated to said upper level on said at least one suction head;

the fluidic resistance of air path through each said holding pipe from said aperture thereof to said duct being greater in sum than the fluidic resistance of air path through each said suction head from said aperture thereof to said duct.

2. The apparatus of claim 1, wherein:

the respective said aperture of each such holding pipe is disposed, when in use, at said upper level; and the cumulative area of all said apertures of said at least one holding pipe is greater than the cumulative area of all said apertures of said at least one suction head.

3. The apparatus of claim 1, wherein:

the said longitudinal bore of each said suction pipe flares at said lower end thereof towards the respective said suction chamber.

4. The apparatus of claim 1, wherein:

each said suction head is made of aluminum.

5. The apparatus of claim 1, wherein:

each said suction head is made of synthetic plastic resin.

6. The apparatus of claim 1, wherein:

each said suction head is made of paper.

7. The apparatus of claim 1, wherein:

said means mounting each such suction head relative to said duct comprises a respective stop shoulder formed on said duct and a respective collar formed on each such suction head for supported engagement with the respective said stop shoulder for limiting downward movement of the respective said suction head.

8. The apparatus of claim 1, wherein:

said apertures of said at least one suction head and of said at least one holding pipe are spatially arranged to confrontingly grip by suction a top sheet of paper from a pile of such paper at sites which are located away from centrally of such sheet substantially towards one edge of such sheet.

* * * * *